US012171379B2

(12) United States Patent
Kurosaki

(10) Patent No.: US 12,171,379 B2
(45) Date of Patent: Dec. 24, 2024

(54) TOILET PAPER HOLDER

(71) Applicant: CORELEX SHIN-EI CO., LTD., Fuji (JP)

(72) Inventor: Satoshi Kurosaki, Shizuoka (JP)

(73) Assignee: CORELEX SHIN-EI CO., LTD., Fuji (JP)

( * ) Notice: Subject to any disclaimer, the term of this patent is extended or adjusted under 35 U.S.C. 154(b) by 312 days.

(21) Appl. No.: 17/801,631

(22) PCT Filed: Jul. 10, 2020

(86) PCT No.: PCT/JP2020/027053
§ 371 (c)(1),
(2) Date: Aug. 23, 2022

(87) PCT Pub. No.: WO2021/229831
PCT Pub. Date: Nov. 18, 2021

(65) Prior Publication Data

US 2023/0086343 A1 Mar. 23, 2023

(30) Foreign Application Priority Data

May 13, 2020 (WO) ..... PCT/JP2020/019084

(51) Int. Cl.
*A47K 10/36* (2006.01)

(52) U.S. Cl.
CPC ..... *A47K 10/3643* (2013.01); *A47K 10/3687* (2013.01); *A47K 2010/3681* (2013.01)

(58) Field of Classification Search
CPC ..... A47K 10/3643; A47K 10/3687; A47K 10/3656
USPC ..... 83/649
See application file for complete search history.

(56) References Cited

U.S. PATENT DOCUMENTS

| | | | | |
|---|---|---|---|---|
| 4,944,466 | A * | 7/1990 | Jespersen | A47K 10/3656 242/561 |
| 5,499,564 | A * | 3/1996 | Sanborn, III | B65H 29/36 83/155.1 |
| 6,997,093 | B2 * | 2/2006 | Koehler | B65H 39/14 83/609 |
| 2006/0175341 | A1 * | 8/2006 | Rodrian | G07F 11/68 221/13 |

(Continued)

FOREIGN PATENT DOCUMENTS

| | | |
|---|---|---|
| CN | 107752884 A | 3/2018 |
| JP | 60-025498 U | 2/1985 |

(Continued)

OTHER PUBLICATIONS

International Search Report for PCT/JP2020/027053, dated Sep. 15, 2020.

*Primary Examiner* — Omar Flores Sanchez
(74) *Attorney, Agent, or Firm* — Sughrue Mion, PLLC

(57) ABSTRACT

Provided is a toilet paper holder that enables a user to easily pull out toilet paper from an accommodated large roll. In this toilet paper holder, a weight member 12 is caused to move upward by tension that is exerted on toilet paper 2*a* when the toilet paper 2*a* is pulled out from a paper cutter 15, and when the tension is released as a result of the paper cutter 15 cutting the toilet paper 2*a*, the weight member 12 moves downward under its own weight, so that the toilet paper 2*a* is pulled out from the roll case 10.

4 Claims, 3 Drawing Sheets

(56) References Cited

U.S. PATENT DOCUMENTS

2007/0236110 A1* 10/2007 Kling ..... A47K 10/36 312/34.4
2008/0116314 A1* 5/2008 Elliott ..... A47K 10/46 242/596.8
2010/0224042 A1* 9/2010 Schafer ..... B65H 35/06 83/418
2010/0286818 A1* 11/2010 Goeking ..... A47K 10/3612 221/30
2011/0276178 A1* 11/2011 Petersen ..... G07C 3/08 700/236
2012/0193466 A1* 8/2012 Chiu ..... A47K 10/3643 242/562
2012/0256036 A1* 10/2012 Osborne ..... A47K 10/3662 242/560
2015/0282678 A1* 10/2015 Larsson ..... A47K 10/36 225/100
2015/0282679 A1* 10/2015 Larsson ..... A47K 10/3643 221/26
2015/0313425 A1* 11/2015 Thorén ..... A47K 10/427 221/1
2018/0325332 A1* 11/2018 Grosz, Jr. ..... A47K 10/3836
2020/0029750 A1* 1/2020 Zimmermann ..... A47K 10/38
2020/0163498 A1* 5/2020 Osborne, Jr. ..... A47K 10/3618
2023/0248189 A1* 8/2023 Osborne, Jr. ..... A47K 10/3625 242/564

FOREIGN PATENT DOCUMENTS

JP 63-019388 U 2/1988
JP 06-011590 U 2/1994
JP 2004-209164 A 7/2004
JP 2004-329309 A 11/2004
JP 2018-143736 A 9/2018

* cited by examiner

TOILET PAPER HOLDER

CROSS REFERENCE TO RELATED APPLICATIONS

This application is a National Stage of International Application No. PCT/JP2020/027053 filed Jul. 10, 2020, claiming priority based on International Patent Application No. PCT/JP2020/019084 filed May 13, 2020.

TECHNICAL FIELD

The present invention relates to a toilet paper holder that accommodates a large roll formed by rolling up toilet paper having a length of several hundreds of meters.

BACKGROUND ART

In order to reduce the frequency of replenishing a toilet paper holder with new toilet paper, there are large rolls (jumbo rolls) each formed by rolling up toilet paper having a length of several hundreds of meters. Although such large rolls are often used mainly in places with high traffic of people, there has been a demand for installing such large rolls in, for example, homes.

An example of a holder that accommodates a large roll is a holder that includes a box-shaped case body in which a large roll is to be accommodated, a stopper that restrains rotation of the large roll, and a cutter blade that is included in the stopper (see, for example, PTL 1).

This holder is configured to be installed by screwing the rear surface of the case body onto a wall or the like, and toilet paper is pulled out parallel to a surface of the wall or the like.

CITATION LIST

Patent Literature

PTL 1: Japanese Unexamined Utility Model Registration Application Publication No. 63-19388

SUMMARY OF INVENTION

Technical Problem

A large roll of toilet paper has a large roll diameter and is heavy when it is unused or the like. Thus, in this case, a larger force is required for pulling out the toilet paper compared with the case of pulling out a normal-sized roll, and it may not be easy to pull it out to a required length.

The present disclosure has been made in view of the above problem and provides a toilet paper holder capable of enabling a user to easily pull out toilet paper from a large roll accommodated in the toilet paper holder.

Solution to Problem

A toilet paper holder according to the present disclosure includes a roll case that accommodates a large roll formed by rolling up toilet paper having a length of several hundreds of meters, a weight member that is disposed below the roll case and that applies a predetermined load to toilet paper pulled out from the roll case, a support member that supports the weight member such that the weight member is movable up and down, a paper cutter into which the toilet paper to which a load is applied by the weight member is inserted and that cuts the toilet paper at an arbitrary position, and a moving-back prevention mechanism that is disposed between the weight member and the paper cutter and that prevents the toilet paper from moving toward the roll case. The toilet paper pulled out from the roll case is brought into contact with or inserted through the weight member, the moving-back prevention mechanism, and the paper cutter in an order of the weight member, the moving-back prevention mechanism, and the paper cutter. When the toilet paper is pulled out from the paper cutter, the weight member is caused to move upward by tension that is exerted on the toilet paper. When the tension is released as a result of the paper cutter cutting the toilet paper at the arbitrary position, the weight member moves downward under own weight of the weight member, and the toilet paper is pulled out from the roll case.

The roll case is mounted on an interior wall. The paper cutter is mounted on an installation panel that covers the roll case. The weight member and the support member are disposed between the interior wall and the installation panel.

The toilet paper holder further includes a paper guide into which the toilet paper pulled out from the roll case is inserted and that changes a width direction of the toilet paper pulled out from the roll case by gently twisting the toilet paper in such a manner as to enable the toilet paper to be inserted through the paper cutter.

Advantageous Effects of Invention

According to the present disclosure, toilet paper can be easily pulled out from an accommodated large roll.

DESCRIPTION OF EMBODIMENTS

An embodiment of the present invention will be described below.

Figure 1:
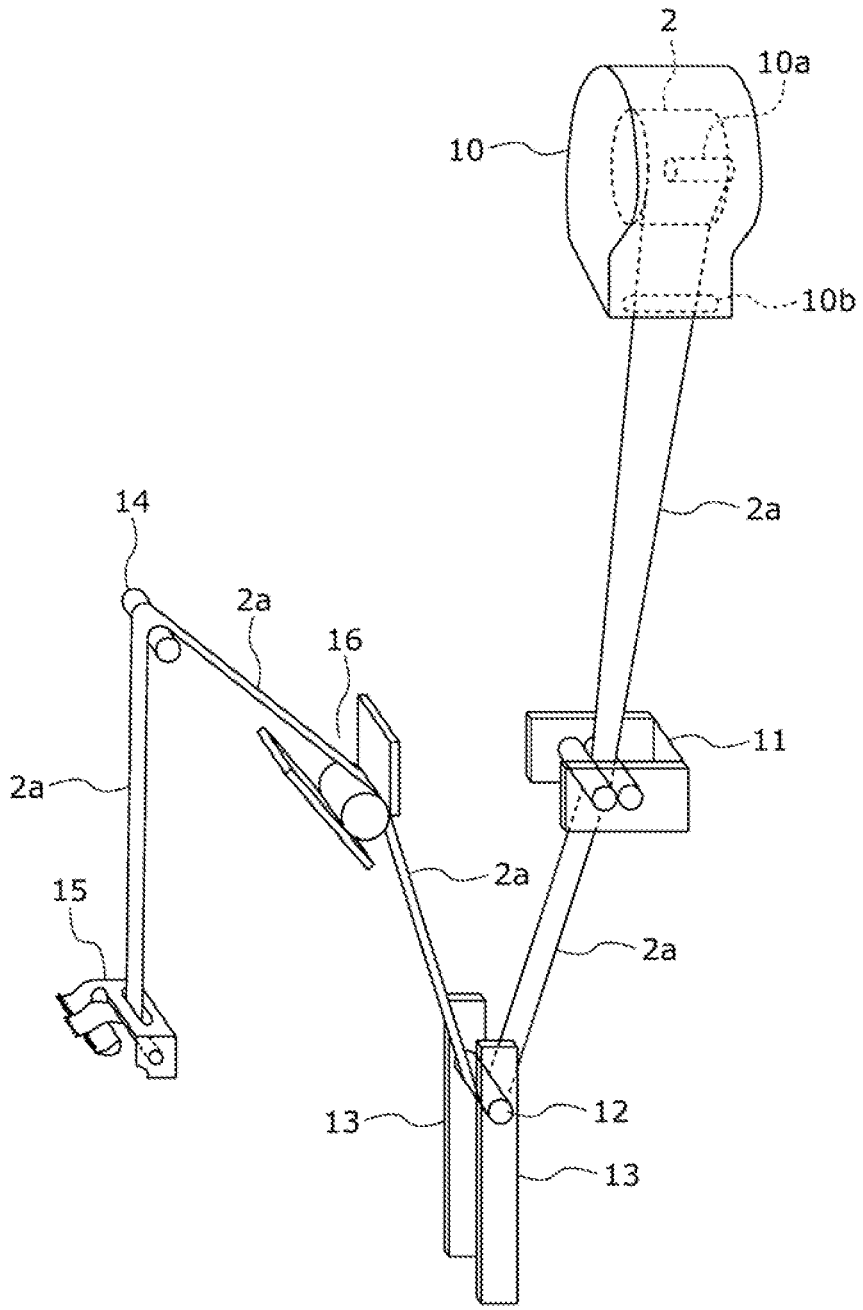
FIG. 1 is a diagram illustrating a schematic configuration of a toilet paper holder according to an embodiment of the present disclosure.

FIG. 1 is a diagram illustrating a schematic configuration of a toilet paper holder according to the embodiment of the present disclosure. FIG. 1 illustrates a state where a toilet paper holder 1 that holds a large paper roll 2 is installed in a bathroom (toilet) or the like. An interior wall 3 of the bathroom or the like on which the toilet paper holder 1 is installed and fixed and an installation panel 4 are not illustrated in FIG. 1.

The toilet paper holder 1 includes a roll case 10 in which the paper roll 2 is to be accommodated, a paper guide 11 that guides toilet paper 2*a*, which is pulled out from the roll case 10, in a predetermined direction, a weight member 12 that applies an appropriate load to the toilet paper 2*a*, a support member 13 that supports the weight member 12, a guide member 14 that changes the direction in which the toilet paper 2*a* is pulled out, a paper cutter 15 that cuts the toilet paper 2*a* inserted therethrough to a desired length, and a moving-back prevention mechanism 16 that prevents the toilet paper 2*a* from moving back toward the paper roll 2 or the like when the toilet paper 2*a* is pulled out from the paper cutter 15.

The roll case 10 has a size and a shape that enable the paper roll 2 formed by rolling up the toilet paper 2*a* having a length of several hundreds of meters to be accommodated in the roll case 10, and the roll case 10 has an opening (not illustrated) through which the toilet paper 2*a* pulled out from the paper roll 2 is sent out to the outside.

The toilet paper 2*a* has a width (e.g., 114 mm) similar to that of a common toilet paper. Thus, the paper roll 2 has a roll diameter that is considerably larger than its roll width and has a short cylindrical shape or a substantially disc-like shape.

Accordingly, the roll case 10 is also formed in a short, substantially cylindrical shape or a substantially disc-like shape and is fixed to the interior wall 3 of the bathroom or the like in such a manner that a circular side surface (a surface extending along a radial direction of the paper roll 2) of the paper roll 2, which is accommodated in the roll case 10, is parallel to a wall surface of the interior wall 3.

The roll case 10 includes a support shaft 10*a* (having a substantially cylindrical shape) that is inserted into a roll center hole of the paper roll 2 accommodated in the roll case 10. The support shaft 10*a* is provided so as to project perpendicularly from the wall surface of the interior wall 3.

The roll case 10 further includes a feeding guide 10*b* that guides the toilet paper 2*a* pulled out from the paper roll 2, which is accommodated in the roll case 10, so as to prevent wrinkles or the like from being generated in the toilet paper 2*a* in a width direction of the toilet paper 2*a* or so as to prevent the toilet paper 2*a* from becoming tangled.

The paper guide 11 is disposed between the roll case 10 and the weight member 12 (the support member 13), and the paper guide 11 is mounted and fixed on the interior wall 3 in such a manner as to be positioned, for example, below the roll case 10 and above the weight member 12.

The width direction of the paper roll 2 accommodated in the roll case 10 is perpendicular to the wall surface of the interior wall 3, and thus, the paper guide 11 is configured to gently twist the toilet paper 2*a* inserted therethrough.

In other words, the paper guide 11 comes into contact with the toilet paper 2*a* as the toilet paper 2*a* is pulled out from the roll case 10, in such a manner that the width direction of the toilet paper 2*a* pulled to outside the roll case 10 is parallel to the wall surface of the interior wall 3 and a surface of the installation panel 4. That is to say, the paper guide 11 is configured to change the width direction of the toilet paper 2*a* so as to enable the toilet paper 2*a* to be inserted through the paper cutter 15 that is mounted on the installation panel 4, which will be described later.

The weight member 12 is formed in such a shape that the weight member 12 comes into contact with the toilet paper 2*a* without tearing the toilet paper 2*a*. For example, the weight member 12 is formed in a rod-like shape, a substantially spherical shape, a substantially oval shape, or the like having such a diameter that the load applied to the toilet paper 2*a* is appropriately dispersed. A surface of the weight member 12 (the surface coming into contact with the toilet paper 2*a*) is a smooth surface that enables the toilet paper 2*a* that is in contact with the weight member 12 to move without being torn.

For example, the weight member 12 has such a weight that the toilet paper 2*a* can be pulled out from the paper roll 2 accommodated in the roll case 10 and that entanglement of paper fibers of the toilet paper 2*a* can withstand a load that is applied from above the toilet paper 2*a* (the load does not exceed the strength of the toilet paper 2*a*).

The support member 13 supports, for example, the two longitudinal ends of the weight member 12 having a rod-like shape so as to enable the weight member 12 to smoothly move in the vertical direction (along the wall surface of the interior wall 3) without any resistance (without generating a resistance that causes tearing of the toilet paper 2*a*, which is in contact with the weight member 12).

The guide member 14 is disposed between the weight member 12 and the paper cutter 15 and mounted on the installation panel 4 that covers, for example, the roll case 10 mounted and fixed on the interior wall 3, the weight member 12 (the support member 13) disposed below the roll case 10, and so forth. More specifically, the guide member 14 is positioned in an opening or the like of the installation panel 4 that causes the toilet paper 2*a*, which is pulled out from the paper roll 2 and is in contact with the weight member 12, to be pulled out toward the inside of the bathroom (the side on which a user is present).

For example, the guide member 14 is disposed above the position at which the weight member 12 is disposed (and the position at which the moving-back prevention mechanism 16 is disposed) and is configured to cause the toilet paper 2*a* that is brought into contact with the weight member 12 and pulled out upward to move downward on a side of the installation panel 4, the side facing the inside of the bathroom. In other words, the guide member 14 is configured to change the direction in which the toilet paper 2*a* is pulled out.

More specifically, the guide member 14 has, for example, a contact surface (circumferential surface) having such a circumferential radius that the toilet paper 2*a* moving from the lower side to the upper side does not tear and is mounted on the installation panel 4 so as to come into contact with the lower side of the toilet paper 2*a* (is disposed between the weight member 12 and the paper cutter 15).

Note that the guide member 14 may be configured to rotate as the toilet paper 2*a* is pulled out and moved.

For example, the paper cutter 15 is mounted and fixed on the side of the installation panel 4, the side facing the inside of the bathroom, and is positioned below the guide member 14. The paper cutter 15 is configured to come into contact with the toilet paper 2*a*, which is inserted therethrough, and press down the toilet paper 2*a*.

In addition, the paper cutter 15 includes a cutter blade (not illustrated) that cuts the toilet paper 2*a* at a position where a user desires to cut the toilet paper 2*a*.

The moving-back prevention mechanism 16 is disposed between the weight member 12 and the guide member 14, and as will be described later, the moving-back prevention mechanism 16 is disposed such that, for example, the moving-back prevention mechanism 16 is positioned above the weight member 12 when the weight member 12 has moved upward and reached its uppermost position.

The moving-back prevention mechanism 16 is configured to enable the toilet paper 2*a*, which is in contact with the weight member 12, to freely move toward the guide member 14 and the paper cutter 15, in other words, the moving-back prevention mechanism 16 is configured to send out the toilet paper 2*a* in one direction.

More specifically, for example, the moving-back prevention mechanism 16 prevents the toilet paper 2*a* inserted therethrough (the toilet paper 2*a* pulled out from the roll case 10) from moving back from the side on which the paper cutter 15 and the guide member 14 are disposed toward the roll case 10 or the paper roll 2 by causing the toilet paper 2*a* to be brought into contact with a predetermined portion of the moving-back prevention mechanism 16.

An operation will now be described.

Figure 2:
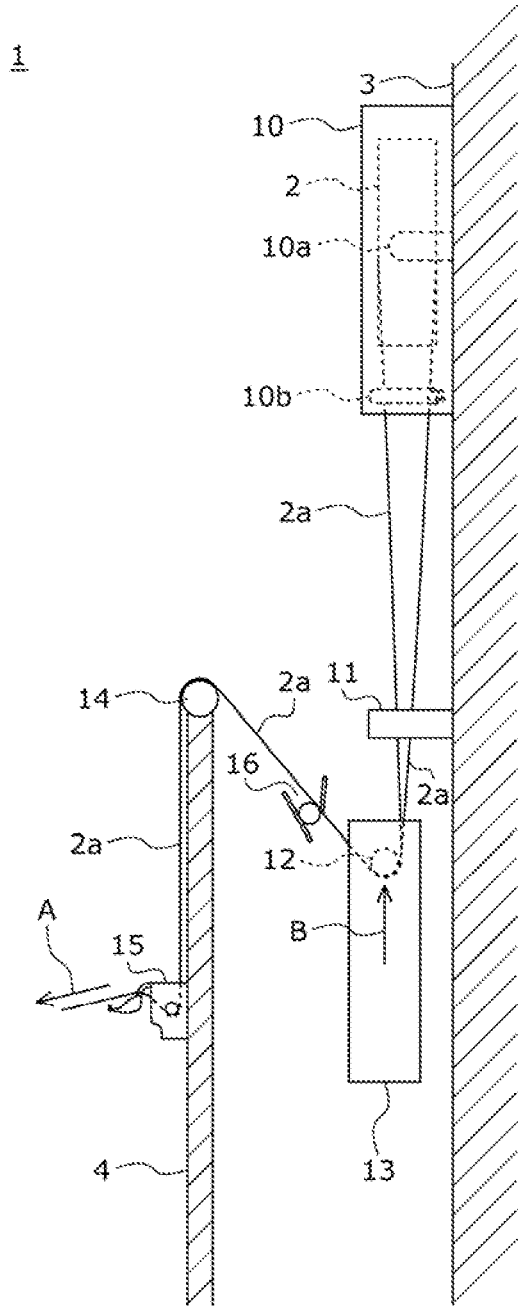
FIG. 2 is a diagram illustrating an operation that is performed when toilet paper is pulled out from the toilet paper holder illustrated in FIG. 1.

FIG. 2 is a diagram illustrating an operation that is performed when the toilet paper 2*a* is pulled out from the toilet paper holder 1 illustrated in FIG. 1.

FIG. 2 illustrates a schematic arrangement of the units included in the toilet paper holder 1 when the toilet paper holder 1 is viewed from the side and illustrates the arrangement position and the operation of each unit when a user or the like pulls out the toilet paper 2*a* from the paper cutter 15.

Figure 3:
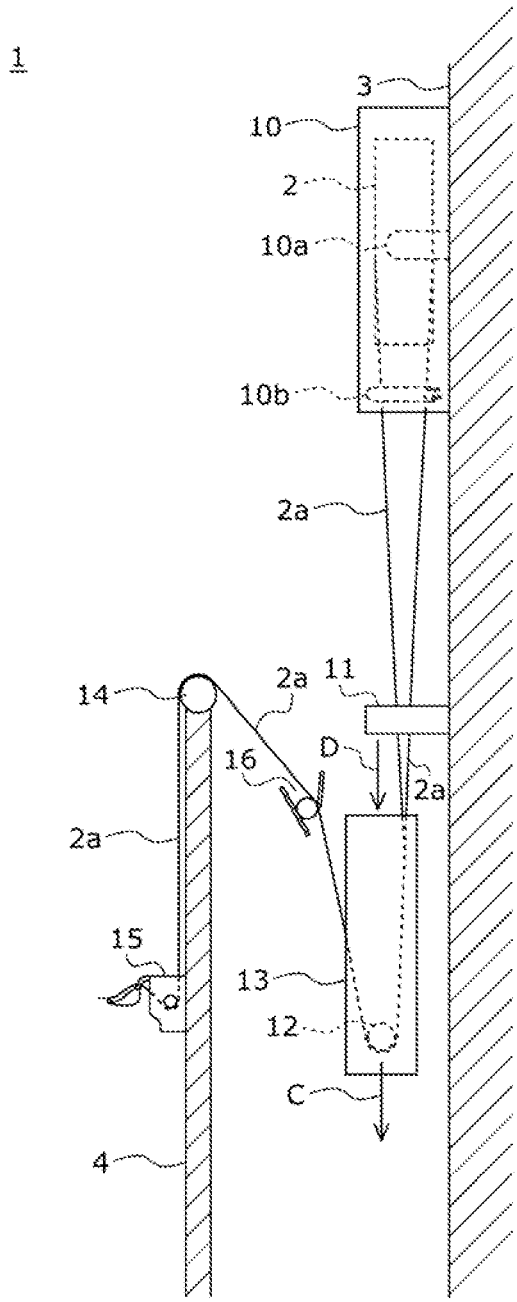
FIG. 3 is a diagram illustrating an operation that is performed after the toilet paper has been pulled out from the toilet paper holder illustrated in FIG. 1.

Note that, as illustrated in FIG. 2 and FIG. 3, the roll case 10, the paper guide 11, and so forth are mounted and fixed on the interior wall 3 of the bathroom or the like, and the guide member 14, the paper cutter 15, and so forth are mounted and fixed on the installation panel 4 that is provided in front side of the interior wall 3 (inside the bathroom or the like).

The toilet paper 2*a* pulled out from the roll case 10 is brought into contact with (or is inserted through) the paper guide 11, the weight member 12, the moving-back prevention mechanism 16, the guide member 14, and the paper cutter 15 in this order.

In other words, when a user or the like pulls out the toilet paper 2*a* inserted through the paper cutter 15, an arbitrary portion of the toilet paper 2*a* pulled out from the roll case 10 moves in such a manner as to reach the paper guide 11, the weight member 12, the moving-back prevention mechanism 16, the guide member 14, and the paper cutter 15 in this order.

When a user or the like pulls out the toilet paper 2*a* from the paper cutter 15 to a desired length, that is, when the toilet paper 2*a* is pulled out from the paper cutter 15 in the direction of arrow A illustrated in FIG. 2, a pulling force acts on the entire toilet paper 2*a* illustrated in FIG. 2, and the toilet paper 2*a* that is located, for example, in the vicinity of the guide member 14, the moving-back prevention mechanism 16, and the weight member 12, moves toward the paper cutter 15.

When the toilet paper 2*a* moves in the manner described above, tension is exerted on the toilet paper 2*a*, and the weight member 12 that is in contact with the upper side of the toilet paper 2*a* is caused to move in the direction of arrow B.

More specifically, when the toilet paper 2*a* moves toward the paper cutter 15, the length of the toilet paper 2*a* that is located between the paper roll 2 and the guide member 14 (the moving-back prevention mechanism 16) decreases, and the above-mentioned tension is generated to rise the weight member 12 upward.

The weight member 12 that is caused to move upward by the tension generated when the toilet paper 2*a* is pulled out from the paper cutter 15 is restrained from reaching a position that is higher than a predetermined height by the support member 13.

In other words, the weight member 12 is supported by the support member 13 so as not to move upward to a predetermined height or higher (e.g., a position higher than the position of the moving-back prevention mechanism 16).

In this case (when the weight member 12 is raised upward or when the toilet paper 2*a* is pulled out from the paper cutter 15), the moving-back prevention mechanism 16 smoothly sends out the toilet paper 2*a* that is in contact with (inserted through) the moving-back prevention mechanism 16 toward the guide member 14.

Note that, when a user continuously pulls out the toilet paper 2*a* from the paper cutter 15 even after the weight member 12 has reached the above-mentioned uppermost position, the toilet paper 2*a* is pulled out from the roll case 10 and moves toward the paper cutter 15 while the weight member 12 is maintained at the above-mentioned uppermost position.

FIG. 3 is a diagram illustrating an operation that is performed after the toilet paper 2*a* has been pulled out from the toilet paper holder 1 illustrated in FIG. 1.

FIG. 3 illustrates a schematic arrangement of the units included in the toilet paper holder 1 when the toilet paper holder 1 is viewed from the side, and illustrates the arrangement position and the operation of each unit after the toilet paper 2*a* has been pulled out from the paper cutter 15 to a desired length by a user or the like and cut at an arbitrary position.

Once a user has cut the toilet paper 2*a* at a desired position by using the paper cutter 15, the tension exerted on the toilet paper 2*a* is released. In other words, the force lifting the weight member 12 disappears.

When the tension is released, the weight member 12 moves in the direction of arrow C (moves downward) under its own weight (the load applied to the toilet paper 2*a*).

In this case, as a result of the weight member 12 moving in the direction of arrow C, a pulling force in the downward direction (in a direction toward the weight member 12) acts on the toilet paper 2*a* that is in contact with (inserted through) the moving-back prevention mechanism 16.

Once this pulling force has been generated, for example, the predetermined portion of the moving-back prevention mechanism 16 strongly abuts against the toilet paper 2*a*, so that the moving-back prevention mechanism 16 holds and prevents the toilet paper 2*a* from moving. In other words, the moving-back prevention mechanism 16 prevents the toilet paper 2*a* from moving (moving back) toward the roll case 10.

In the manner described above, a portion of the toilet paper 2*a* that is in contact with (inserted through) the moving-back prevention mechanism 16 is brought into an immovable state, and when the weight member 12 moves downward (in the direction of arrow C) under its own weight, the length of the toilet paper 2*a* located between the paper roll 2 and the weight member 12 increases.

In other words, as a result of the weight member 12 moving downward, the toilet paper 2*a* is further pulled out from the roll case 10 (the paper roll 2).

Note that the support member 13 may include an assisting mechanism or the like that detects that the weight member 12 starts moving downward and that helps the weight member 12 move downward.

The assisting mechanism or the like is configured to adjust the magnitude of the load applied to the toilet paper 2*a* by the weight member 12 so as to reduce the possibility that the toilet paper 2*a* will be torn while the load is applied to the toilet paper 2*a*.

In addition, the assisting mechanism or the like may be configured to adjust the magnitude of the load applied by the weight member 12 moving downward in such a manner that the toilet paper 2*a* can be smoothly pulled out from the paper roll 2, which is a large roll that requires a large force (e.g., a force larger than the load applied by the weight member 12) when it is rotated.

In the toilet paper holder 1, the length of the toilet paper 2*a* that is pulled out from the roll case 10 is set in accordance with the distance the weight member 12 moves downward.

Thus, the support member 13 is configured to be capable of allowing the weight member 12 to move in the vertical direction (to have a travel distance) in such a manner that the toilet paper 2*a* having a sufficient length is pulled out from the roll case 10 (the paper roll 2).

Note that, instead of employing the moving-back prevention mechanism 16, the guide member 14 may have the functions of the moving-back prevention mechanism 16. In other words, the toilet paper holder 1 does not need to include the moving-back prevention mechanism 16, and a portion of the guide member 14 that comes into contact with the toilet paper 2*a* may be configured to prevent the toilet paper 2*a* from moving back toward the roll case 10.

When the weight member 12 moves downward (toward the weight member 12), a pulling force acts on the toilet paper 2*a*. This pulling force acts from the side on which the guide member 14 is disposed toward the weight member 12, and a portion of the toilet paper 2*a* that is in contact with the guide member 14 is strongly pressed against the guide member 14.

As a result of the toilet paper 2*a* being strongly pressed against the guide member 14 in the manner described above, a frictional force having an appropriate magnitude (such a magnitude that the toilet paper 2*a* is not torn by the frictional force) is generated between a surface of the guide member 14 and the toilet paper 2*a*, and the toilet paper 2*a* located between the guide member 14 and the weight member 12 does not move toward the weight member 12 and is fixed in place to be stationary.

The portion of the guide member 14 that comes into contact with the toilet paper 2*a* may be configured such that, for example, the frictional force generated between the guide member 14 and the toilet paper 2*a* becomes small when the toilet paper 2*a* moves from the side on which the weight member 12 is disposed toward the paper cutter 15 (the weight member 12 moves upward).

In addition, it is preferable that a mechanism or the like that reduces the load, which is applied to the toilet paper 2*a* by the weight member 12, when the weight member 12 moves upward be provided at a suitable place.

Note that, in the case where the guide member 14 includes a portion that rotates along with movement of the toilet paper 2*a*, the portion that rotates (the portion that comes into contact with the toilet paper 2*a*) of the guide member 14 is configured to rotate in only one direction.

More specifically, the portion that rotates or the like is provided with a mechanism or the like that allows the portion that rotates or the like to rotate in the direction in which the toilet paper 2*a*, which is in contact with the guide member 14, moves toward the paper cutter 15 and that does not allow the portion that rotates or the like to rotate in the direction in which the toilet paper 2*a*, which is in contact with the guide member 14, moves toward the weight member 12.

As described above, according to the present embodiment, the moving-back prevention mechanism 16 and so forth prevents the toilet paper 2*a* pulled out from the roll case 10 from moving back, and the toilet paper 2*a* is pulled out from the roll case 10 (the paper roll 2) as a result of the weight member 12 moving downward, so that a user or the like can pull out the toilet paper 2*a* from the paper cutter 15 with a relatively small force.

The roll case 10, the weight member 12, the support member 13, and so forth are arranged in such a manner as to be covered with the installation panel 4, and thus, the interior of a room such as a bathroom can have a favorable appearance.

In addition, the roll case 10 and so forth are arranged in such a manner that the circular side surface of the paper roll 2 is parallel to the wall surface of the interior wall 3, and thus, a space inside the room, such as a bathroom, that is occupied by the toilet paper holder 1 can be reduced.

REFERENCE SIGNS LIST

1 toilet paper holder
2 paper roll
3 interior wall
4 installation panel
10 roll case
10*a* support shaft
10*b* feeding guide
11 paper guide
12 weight member
13 support member
14 guide member
15 paper cutter
16 moving-back prevention mechanism

The invention claimed is:

1. A toilet paper holder comprising:

a roll case that accommodates a large roll formed by rolling up toilet paper having a length of several hundreds of meters;

a weight member that is disposed below the roll case and that applies a predetermined load to toilet paper pulled out from the roll case;

a support member that supports the weight member such that the weight member is movable up and down;

a paper cutter into which the toilet paper to which a load is applied by the weight member is inserted and that cuts the toilet paper at an arbitrary position; and a moving-back prevention mechanism that is disposed between the weight member and the paper cutter and that prevents the toilet paper from moving toward the roll case, wherein the toilet paper pulled out from the roll case is brought into contact with or inserted through the weight member, the moving-back prevention mechanism, and the paper cutter in an order of the weight member, the moving-back prevention mechanism, and the paper cutter, wherein, when the toilet paper is pulled out from the paper cutter, the weight member is caused to move upward by tension that is exerted on the toilet paper, and wherein, when the tension is released as a result of the paper cutter cutting the toilet paper at the arbitrary position, the weight member moves downward under its own weight of the weight member, and the toilet paper is pulled out from the roll case.

2. The toilet paper holder according to claim 1, wherein the roll case is mounted on an interior wall, wherein the paper cutter is mounted on an installation panel that covers the roll case, and wherein the weight member and the support member are disposed between the interior wall and the installation panel.

3. The toilet paper holder according to claim 1, further comprising:

a paper guide into which the toilet paper pulled out from the roll case is inserted and that changes a width direction of the toilet paper pulled out from the roll case by gently twisting the toilet paper in such a manner as to enable the toilet paper to be inserted through the paper cutter.

4. The toilet paper holder according to claim 2, further comprising:

a paper guide into which the toilet paper pulled out from the roll case is inserted and that changes a width direction of the toilet paper pulled out from the roll case by gently twisting the toilet paper in such a manner as to enable the toilet paper to be inserted through the paper cutter.

* * * * *